United States Patent [19]

Humkey et al.

[11] 4,042,220

[45] Aug. 16, 1977

[54] APPARATUS FOR SOLIDS BLENDING

[75] Inventors: Robert Garnett Humkey; Donald Raymond Marshall, both of Orange; Donald James Ryan, Nederland, all of Tex.

[73] Assignee: E. I. Du Pont de Nemours and Company, Wilmington, Del.

[21] Appl. No.: 714,997

[22] Filed: Aug. 17, 1976

Related U.S. Application Data

[60] Continuation-in-part of Ser. No. 618,888, Oct. 2, 1975, abandoned, which is a continuation-in-part of Ser. No. 439,847, Feb. 6, 1974, abandoned, which is a division of Ser. No. 267,200, June 28, 1972, Pat. No. 3,807,705.

[51] Int. Cl.[2] ..... B01F 13/02

[52] U.S. Cl. ..... 259/95; 259/4 R

[58] Field of Search ..... 259/95, 4, 180, 150, 259/DIG. 17, 18, 36, 60

[56] References Cited

U.S. PATENT DOCUMENTS

| | | | |
|---|---|---|---|
| 3,258,252 | 6/1966 | Lanier | 259/95 |
| 3,318,582 | 5/1967 | Fisher | 259/97 |
| 3,337,194 | 8/1967 | Zavasnik | 259/180 |
| 3,409,273 | 11/1968 | Kelly | 259/4 R |
| 3,448,968 | 6/1969 | Young | 259/180 |
| 3,647,188 | 3/1972 | Solt | 259/4 R |

*Primary Examiner*—Robert W. Jenkins

[57] ABSTRACT

Apparatus for the blending of a bed of particulate solids operating cyclically by selectively regulated downward gravity flow of a fraction of the solids, fluidized mixing outside of the bed, followed by recycle to the top of the bed.

10 Claims, 22 Drawing Figures

Fig. 1A.
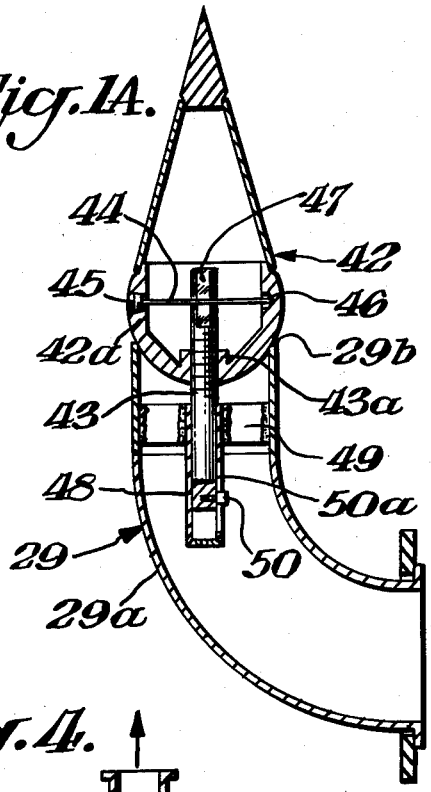
Fig. 5.
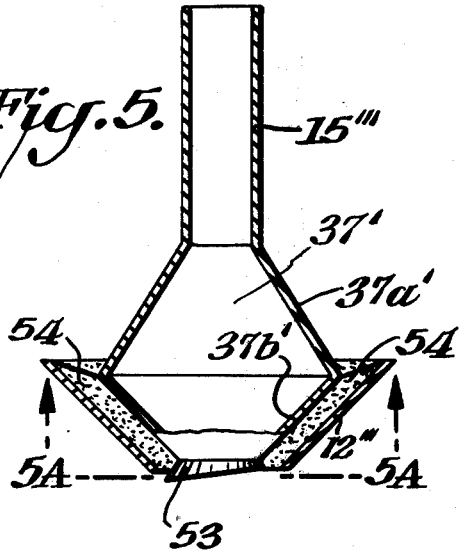
Fig. 4.
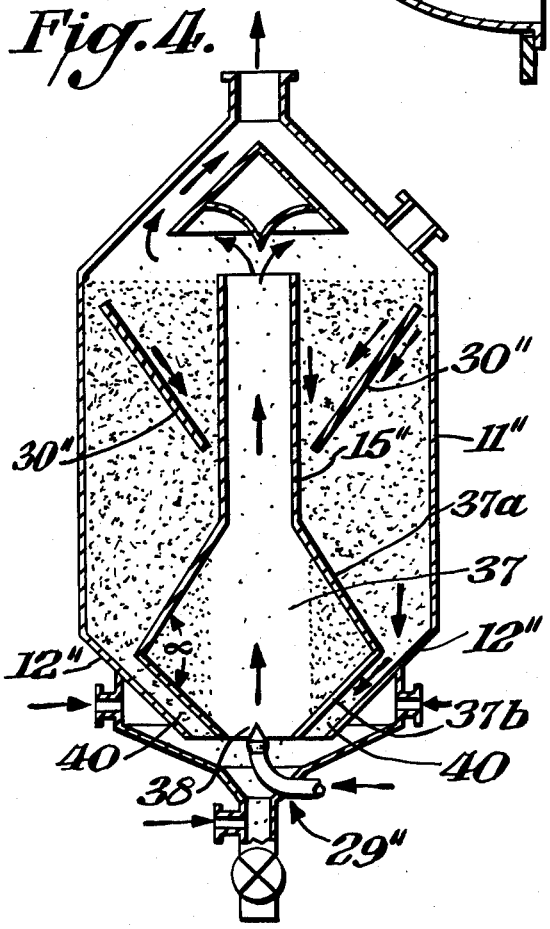
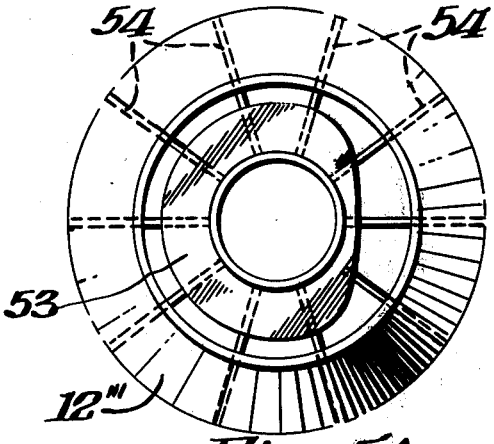
Fig. 5A.

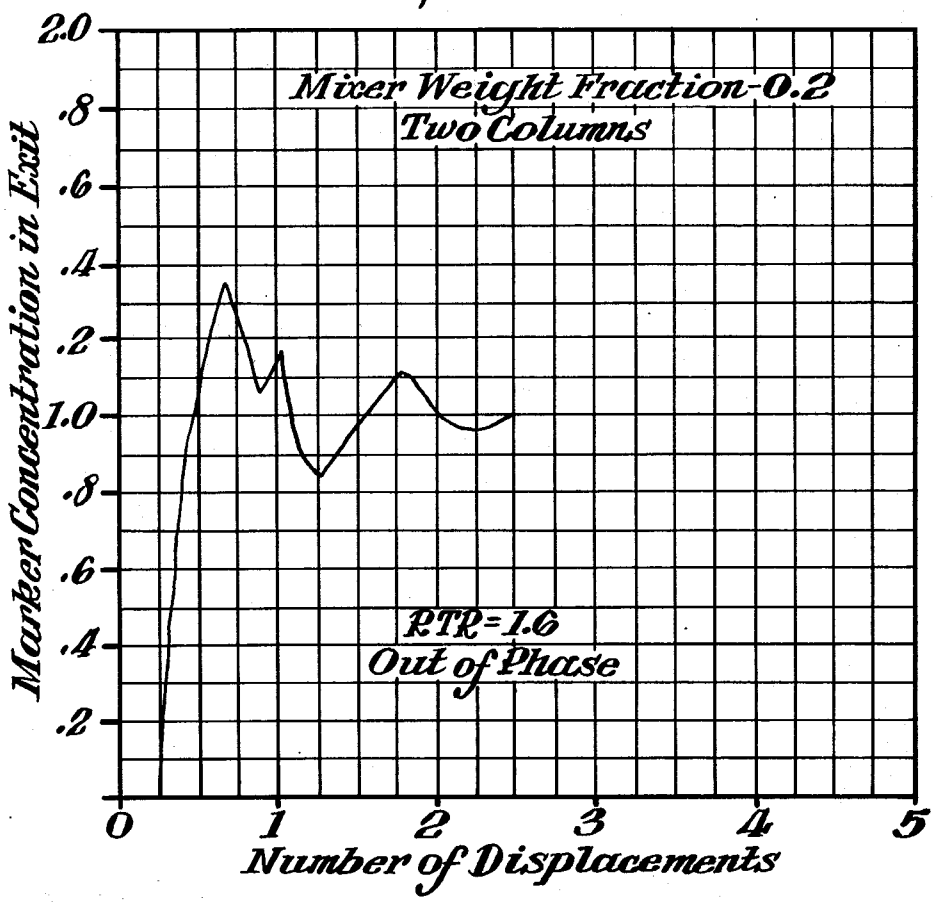
Fig. IIB.
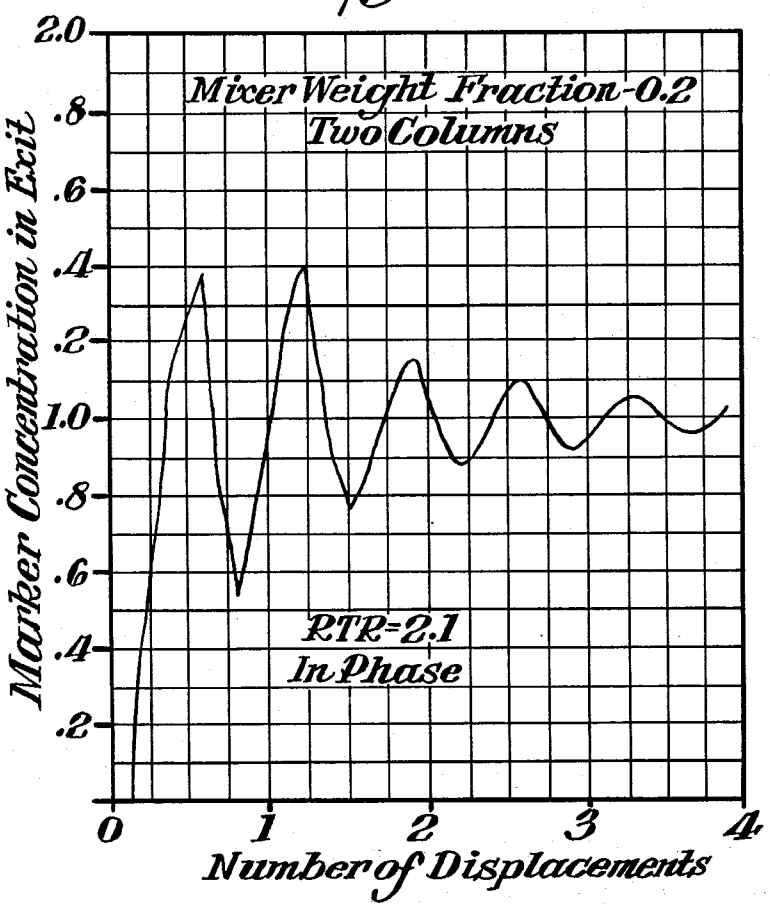
Fig. IIA.

Math. vs. Physical Model
4 Columns, 0.5 Fill, f=0.02

Residence Time Distributions
⊙ Column Residence Time Linear With Col. No.
× Column Velocity Linear With Col. No.
Residence Time Ratio=3.33, 8 Columns
Bed Displacement Time=Constant, MWF=0.0

APPARATUS FOR SOLIDS BLENDING

CROSS REFERENCE TO RELATED APPLICATIONS

This Application is a continuation-in-part of U.S. patent application Ser. No. 618,888, filed Oct. 2, 1975, which latter was a continuation-in-part of application Ser. No. 439,847, filed Feb. 6, 1974, both now abandoned, which, in turn, was a divisional application based on application Ser. No. 267,200, filed June 28, 1972, now U.S. Pat. No. 3,807,705, issued Apr. 30, 1974.

BRIEF SUMMARY OF THE INVENTION

Generally, this invention is an apparatus for blending a bed of particulate solids comprising, in sequence, maintaining different residence times of separate weight fractions of the solids within the bed while withdrawing the solids in downward gravity flow from the bed, feeding the weight fractions of solids to a common gas fluidization mixing zone, intimately mixing the solids by gas fluidization and recycling the solids from the mixing zone to the bed.

DRAWINGS

In the drawings,

FIG. 1 is a partially schematic cross-sectional side elevation view of one embodiment of blending apparatus according to this invention provided with planar baffles, FIG. 1A is a partially schematic cross-sectional side elevation view of the main entrainment gas supply nozzle of the apparatus of FIG. 1, FIG. 2 is a full plan view taken on line 2—2, FIG. 1, FIG. 3 is a partially schematic cross-sectional side elevation view of a second embodiment of blender according to this invention provided with helical baffles, FIG. 4 is a partially schematic cross-sectional side elevation view of a third embodiment of blender according to this invention provided with both planar baffles and an enlarged antechamber at the inlet end of the draft tube, FIG. 5 is a partially schematic cross-sectional side elevation view of a solids flow throttling means for a fourth particularly preferred embodiment of this invention, FIG. 5A is an enlarged (2X) view looking upwards from line 5A—5A, FIG. 5, FIG. 6 is a log-log plot of Mixer Weight Fraction versus Number of Displacements to Blend for the two conditions (a) layer fill and (b) 0.5 fill for apparatus according to this invention, FIG. 7 is a plot of Residence Time Ratio (Maximum/-Minimum) versus Number of Displacements to Blend as to which the Mixer Weight Fraction (f) was preselected to be 0.05, 0.10 and 0.20, respectively, FIG. 8 is a plot of Residence Time Ratio (Maximum/-Minimum) versus Number of Displacements to Blend wherein the Column Residence Time was preselected to increase linearly with column number for Mixer Weight Fractions (f) of 0.02, 0.05 and 0.10, respectively, FIG. 9 is a plot of Residence Time Ratio (Maximum/-Minimum) versus Number of Displacements to Blend, with Mixer Weight Fraction (f) = 0.10 in all cases for the different total number of columns of solids exiting the apparatus preselected to be 3, 4, 5, 6 and 12, respectively, FIG. 10 is a plot of Residence Time Ratio (Maximum/Minimum) versus Number of Displacements to Blend for two different two column-blenders operating with 0.5 fill and having preselected Mixer Weight Fractions (f) of 0.1 and 0.2, respectively, FIGS. 11A and 11B are plots of Number of Displacements versus Marker Concentration in Exit for two column apparatus configurations operating with 0.2 Mixer Weight Fractions for an in-phase Residence Time Ratio (Maximum/Minimum) of 2.1 and an out-of-phase Residence Time Ratio (Maximum/Minimum) of 1.6, respectively, FIG. 12 is a schematic side elevation cross-sectional view of a four-column physical model apparatus which was constructed to verify the mathematically predicted operation of blending apparatus constructed according to this invention, FIG. 13 is a comparative plot of Residence Time Ratio (Maximum/Minimum) versus Number of Displacements to Blend (a) as computed and (b) as measured using the apparatus of FIG. 12, FIG. 14 is a plot of Column Number versus Column Residence Time/Blender Displacement Time for the conditions (a) column residence timer linear with column number (full line plot) and (b) column velocity linear with column number (broken line plot), respectively, FIG. 15 is a broken section plan view looking upwards of a preferred design of solids flow-constricting valves employed in a preferred embodiment of this invention, FIG. 16 is a sectional view taken on line 16—16, FIG. 15, FIG. 17 is a plan view of a fifth embodiment of a solids flow regulating means showing only one half of the metering orifices, i.e., only the orifices for a 180° expanse of the annular space between the frusto-conical bottom section of the blender apparatus and the outside of the lower half of the antechamber of FIG. 4, FIG. 18 is a plan view looking downwards taken at the junction plane of the cylindrical top section with the frusto-conical bottom section of a sixth embodiment of a solids flow regulating means in association with an antechamber 37 which is broken away to show only the lowermost entrance end of **37*b*, wherein chutes of different preselected inward inclinations are employed as the solids flow metering means, and FIG. 18A is a section taken on line 18A—18A of FIG. 18**.

DETAILED DESCRIPTION

Solids blending according to this invention is intended to have application to quite uniformly sized particulate solids, such as pelletized polyethylene and the like, as distinguished from solids mixtures having a relatively wide distribution of particle sizes such as, for example, dry Portland cement-aaggregate mixes.

This invention utilizes sequential (1) gravity-flow downward progression of solids through a relatively dense bed, during which a substantial proportion of the solids are delayed in passage by baffles or other flow regulators whereas the remainder of the solids gravitates downwardly relatively unhindered, (2) fluidized solids mixing and (3) recycling of solids to the bed.

Figure 1:
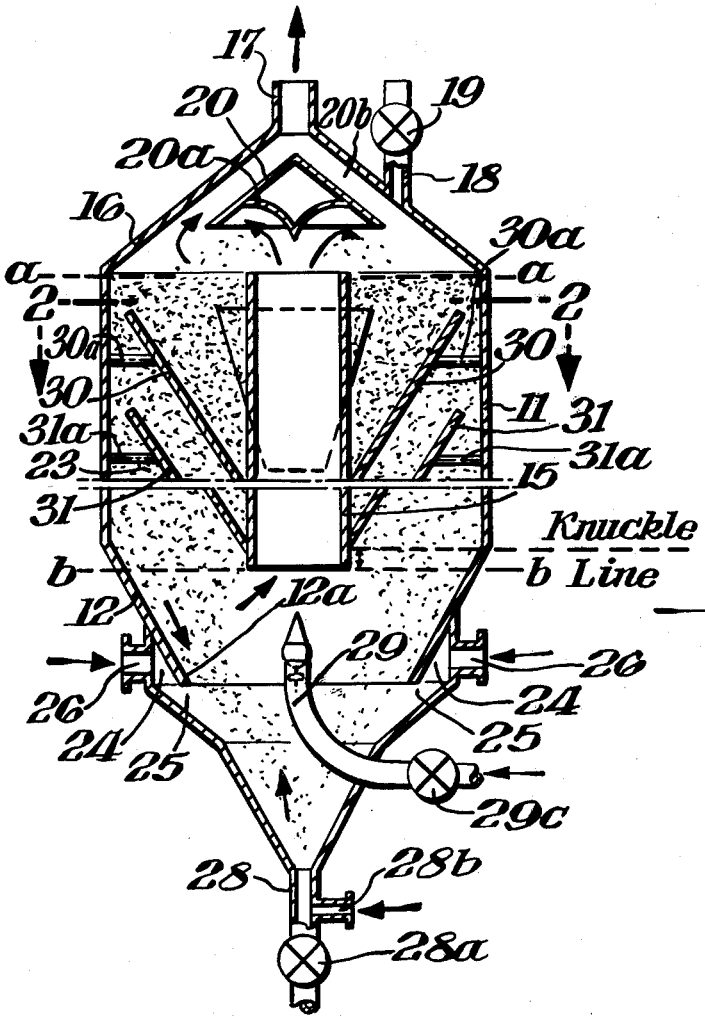

Referring to FIG. 1, one embodiment of my apparatus comprises a vessel having a cylindrical top section 11 closed at the bottom by a frusto-conical bottom section 12. A draft tube 15 is, in this design, mounted coaxially of top section 11 with lower end in open communication with bottom section 12 and upper end in open communication with top section 11.

Optimum solids loading level for the apparatus is along line *a—a,* disposed slightly below the top end of tube 15.

The roof closure of the apparatus, which is not critical to operation, in this instance consists of a squat frusto-conical member 16 which is provided with a centrally located gas discharge pipe 17 and a raw unblended solids introduction pipe 18 in circuit with which is valve 19.

To prevent entrainment discharge from draft tube 15, a solids deflector 20 is disposed coaxially with respect to tube 15 about one tube radius thereabove and provided with a circularly dished, downwardly oriented deflection hood 20*a.* Solids striking hood 20*a* are deflected downwardly into the main bed of solids, denoted at 23, whereas gas exhausted from tube 15 is led out through annular passage 20*b* and thence through discharge pipe 17 to a dust collector (not shown) or to the atmosphere, as desired.

Conical bottom section 12 is provided with a plenum chamber 24 extending around the entire circumference of the cone at about half height, the bottom edge of which is sloped downwardly to provide, with the inner wall overhang 12*a* of the cone, a continuous peripheral slot 25 through which solids fluidizing gas is supplied via nozzles 26 spaced at equal angular intervals around the cone section outside periphery.

A T-fitting 28 is connected to the apex of conical section 12 with the axial branch fitted with a solids gravity-flow drain valve 28*a.* The side branch, 28*b,* is a nozzle for the supply of entrainment gas during solids blending operation of the apparatus. In addition, main entrainment gas supply nozzle 29 is inserted through the side wall of cone 12 with discharge end aligned axially upward of draft tube 15 at a level approximately one draft tube diameter below the lower end of tube 15 giving particularly good solids entrainment.

As detailed in FIG. 1A, nozzle 29 comprises an upwardly bent pressurized air supply conduit 29*a* provided at its discharge end with an upwardly directed conically-formed hollow check valve element 42, which is raised axially upward from its seat at the discharge end 29*b* of conduit 29*a* to permit air discharge upwardly from nozzle 29. To effect this operation, and at the same time retain the check valve in correct vertical alignment for accurate gravity reseating within discharge end 29*b,* the valve is provided with an axially disposed threaded guide shaft 43 which is secured against rotation at its upper end within the hollow base member 42*a* of valve element 42 by pin 44 inserted through drilled hole 45 aligned with a companion blind bore 46 disposed diametrically opposite thereto. Pin 44 lies loosely across a transverse flat 47 formed by cutting away approximately one half of the thickness of the upper end of shaft 43. The lower end of shaft 43 is slidably guided within a vertical tube piece 48 coaxially supported by an open spider horizontal framework 49 weld-attached to the inside of conduit 29*a.* A set screw 50 attached to the base end is slidable within longitudinal slot 50*a* cut in piece 48, thereby locking shaft 43 against rotation during screw adjustment of valve element 42 longitudinally of shaft 43. In operation, when air is supplied under pressure through nozzle 29, element 42 rises from seat 29*b,* thus providing solids entrainment air supply into the bottom of draft tube 15. When air supply is discontinued, check valve element 42 immediately drops back on seat 29*b,* thereby preventing back flow of solids into nozzle 29.

Figure 2:
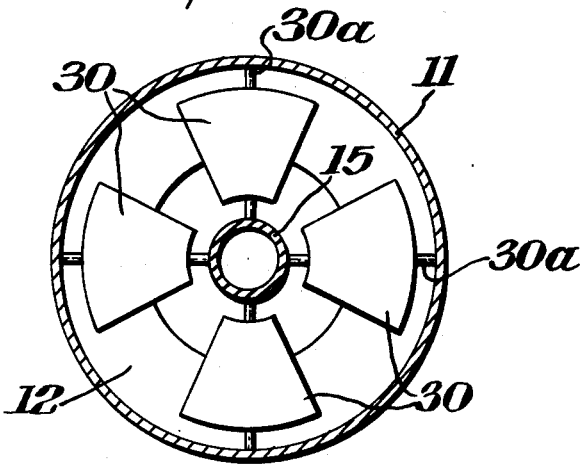

Referring also to FIG. 2, the blender of FIG. 1 is provided with four planar baffles 30 at the same horizontal level supported by struts 30*a* connecting with the inside wall of section 11 and the exterior of draft tube 15. Baffles 30 are disposed equiangularly around the annular blender inner space at approximately equal end spacings of, typically, 6.5% of the diameter of section 11 from confronting apparatus elements and at inward inclinations of, typically, 34°. The upper ends of baffles 30 lie at, typically, 10% bed depth level below *a—a,* with the lower ends at about 45% total bed depth level. As seen in FIG. 2 particularly, the collective projected areas of baffles 30 aggregate about 50% of the full annular cross-sectional area bounded by the inside periphery of top section 11 and the outside periphery of draft tube 15.

A second set of four planar baffles 31, not shown in full in FIG. 1, identical in all respects with baffles 30, is mounted coparallel with and in vertical alignment with respect to baffles 30 at a substantial spacing therefrom. The upper ends of baffles 31 typically lie at about 55% bed depth, whereas the lower ends lie at about 90% bed depth.

In operation, start-up is preferably effected by first introducing the solids to be blended and then supplying fluidizing gas, usually air, unless a different gas is required for chemical activity reasons, via nozzles 26. The fluidizing gas pressure is preselected in relationship to bed 23 depth so that the bed seals against excessive gas leakage, a pressure drop of, typically, 2 inches $H_2O$/ft. of bed depth being taken in the blending of high density polyethylene having a roughly spherical particle size of 2.5 to 3.5 mm. in diameter. At this stage, valves 28*a* and 29*c* are opened to introduce enough entrainment gas to elevate solids from the bottom of section 12, whereupon a fluidized solids zone extending over substantially the full depth of cone 12 (i.e., below line *b—b*) for typically, 80% to 90% of the diameter of the cylindrical section, is maintained below the lower end of draft tube 15, with some solids entrainment through tube 15 occurring. However, for best control of entrainment recycle, it is preferred to supply a portion of entrainment gas via nozzle 29, and this is accomplished by suitable adjustment of control valve 29*c.* Also, nozzle 29 can be adjustable in elevation for further control of solids entrainment. Solids flow in lbs./min. can be adjusted over a broad range, as detailed in the report of comparative operation set out in Table I infra.

During blending, the particles in bed 23 are supported in air to an extent where they possess a low angle of repose of about 18°. As downward gravitation occurs in replacement of entrained solids recycled by draft tube 15, the particles overlying baffles 30 and 31 are delayed somewhat as compared to the downward progress of the remaining particles. Thus, different residence times of separate weight fractions of the solids within the bed 23 are maintained while withdrawing the solids in downward gravity flow from the bed, which effects blending during progress of the solids through the bed. Vigorous blending next ensues within the fluidization zone of conical section 12, followed by yet more blending during solids entrainment recycle through tube 15.

Figure 3:
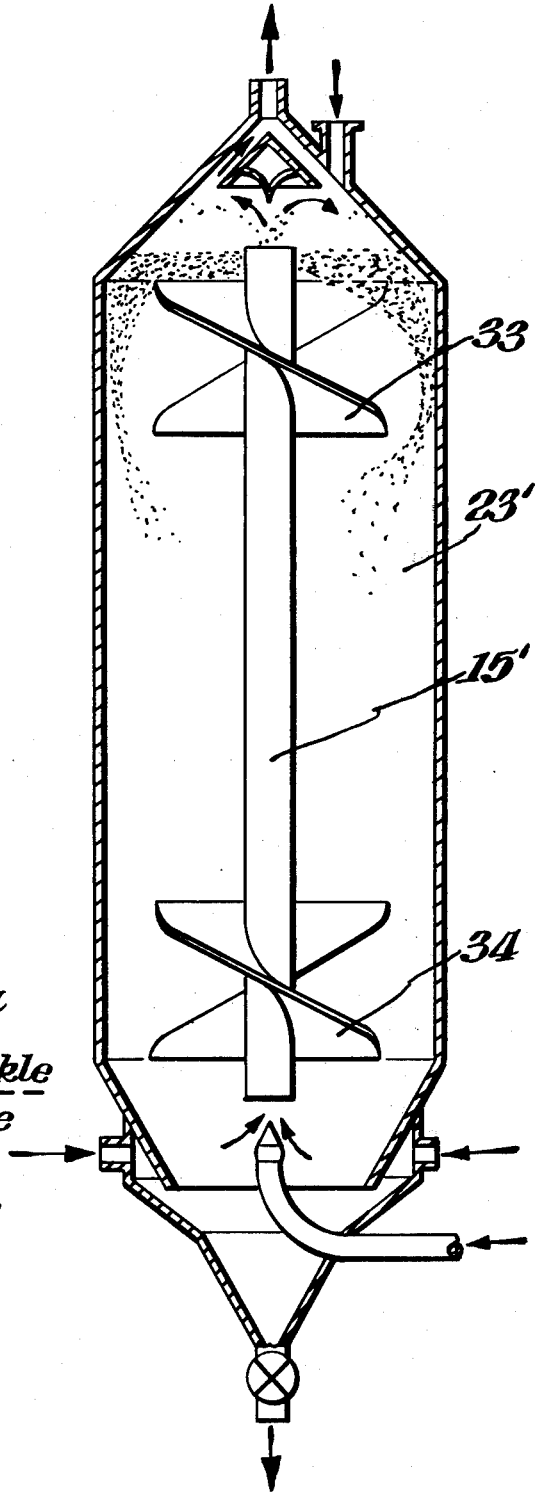

Referring to FIG. 3, there is shown a second embodiment of blending apparatus employing a pair of identical twin flight, half turn helical plate baffles 33 and 34 mounted coaxially with respect to central draft tube 15'. These baffles have a radius, referred to the longitudinal axis of the blender apparatus such that the outer limit line of the baffles lies at approximately 60% of the bed 23' radial extent. Upper baffle 33 occupies approximately the first quarter of bed 23' depth, whereas lower baffle 34 occupies approximately the last quarter. Helical baffling has proved especially effective for high ratio length-to-diameter blender configurations. All remaining construction is as hereinbefore described for the blender of FIG. 1.

Referring to FIG. 4, there is shown a design of blender wherein the draft tube 15" is expanded at the lower end to provide an antechamber 37 having its lower end completely within frusto-conical bottom section 12". The antechamber can conveniently comprise two frusto-conical elements **37*a* and 37*b* joined by welding at their large diameter ends to give a maximum diameter at the junction line approximately twice the diameter of draft tube 15". The inlet opening 38 to antechamber 37 is approximately the same diameter as the inside diameter of tube 15", and the converging walls of frusto-conical element 37*b* diverge slightly away from the confronting walls of frusto-conical bottom section 12" after approaching to the closest clearance corresponding to about 90% of the radius of the vessel cone at the junction line of element 37*a* with element 37*b*. Angle $\alpha$ of antechamber 37 measured, typically, 113°, so that the wall 37*a* is sloped away from the horizontal at an angle of about 57°, much greater than the angle of repose of about 27° for the polyethylene pellets being blended. The foregoing angles apply for vessels having conical sections 12"** of 60° included angle.

The annular area measured at the level of the juncture line of elements **37*a* and 37*b* should be in the range of about 5–20% of the full horizontal section area of cylindrical shell 11", dependent on the diameter and height of draft tube 15"**. This is done to decrease the bed air flow necessary to obtain the $\Delta P$ for conveying in the draft tube. The $\Delta P$/ft. in the annular area must not exceed about 6 inches $H_2O$/ft., otherwise one does not get downward pellet flow.

The apparatus of FIG. 4 is otherwise similar in all respects to the design hereinbefore described with reference to FIG. 1, except that only four planar baffles 30" instead of eight are required due to its lower height.

Operation of the apparatus of FIG. 4 is the same as described for the other embodiments, except that, due to the placement of nozzle 29" within opening 38, fluidization of the solids processed occurs largely within antechamber 37 and, as to it, within the side angle regions almost exclusively. The central path is taken by entrained particles, as indicated by the smaller number particle density represented within this space.

An important advantage of the antechamber construction described is that much more stable fluidization is obtained, because of removal of the weight of the higher pellets in the bed. The added resistance presented to gas leakage out through annular passage 40, of course, reduces markedly the operating gas requirement and thus realizes economies.

The following five examples present a comparison of operation of the several embodiments of blending apparatus hereinbefore described wherein the material blended was particulate polyethylene in the general size range of 2.5 to 3.5 mm. diameter.

TABLE I

| | EXAMPLE NO. | | | | |
|---|---|---|---|---|---|
| | I | II | III | IV | V |
| Diameter of cylindrical top section 11 in inches | 6" | 6" | 23" | 23" | 23" |
| Height (in inches) of cylindrical top section 11 + frusto-conical section 12 | 72" | 72" | 72" | 72" | 56" |
| Included angle, frusto-conical section 12 | 60° | 60° | 34° | 34° | 60° |
| Charge weight, lbs. | 40 | 40 | 365 | 365 | 275 |
| Draft tube 15 dia., inches | 1.4 | 1.5 | 5.5 | 4.5 | 4.5 |
| Draft tube 15 position below knuckle line | 1" | 1" | ½" | 12" | 11" |
| Baffles | None | Helical | 8 Planar | 8 Planar | 4 Planar + antechamber |
| FIGURE reference | 3 | 3 | 1 | 1 | 4 |
| Air Flow, total cfm | 33 | 33 | 580 | 385 | 250 |
| Bed Pressure Drop, "$H_2O$ | 2.0/ft. | 1.1/ft | 3.9/ft | 1.8/ft | 0.1/ft |
| Pellet recycle, lb./min. | 51 | 18.6 | 260 | 190 | 80 |
| Blend Time, min. | 35 | 5.0 | 2.5 | 3.5 | 5.0 |
| *Number of Displacements to Blend | 46 | 3.3 | 2.8 | 2.8 | 2.5 |

*The displacements here reported include the final dumping of all solids from each apparatus, which is taken to be the equivalent of one displacement.

In Example I, the blending apparatus of FIG. 3 was operated without baffles 33 and 34 installed; however, blender was conducted with sequential fluidization in the conical bottom section followed by draft tube entrainment, pellet and air separation and gravity flow through the packed bed, and uniform blended product was obtained after 35 minutes of operation with the gas (in this instance air) and pellet flow reported. This Example shows that relatively long blending times tend to be required for vessels having a large overall height diameter ratio.

Example II shows that the blending time for the same material processed in the same height/diameter ratio blending using the same air flow rate, but with the apparatus provided with helical baffles 33 and 34 as shown in FIG. 3, can be dramatically reduced to 5 minutes.

Example III shows the increase in air consumption required as the diameter of the blending vessel is increased. With eight planar baffles and the high pellet flow rate of 260 lbs./min. reported, blending time was reduced to the very low value of 2.5 minutes, but at the cost of a considerably increased air flow rate.

In an effort to reduce air consumption, the identical apparatus of Example III was altered for Example IV by disposing the lower end of draft tube 15 well below (i.e., 12 inches below) the knuckle line, whereupon air consumption was reduced by at least 35%. However, the blending time increased approximately in the same proportion to 3.5 minutes.

Example V illustrates the advantage of the antechamber in reducing air consumption, the apparatus of FIG. 4 realizing a blend time change over the unbaffled apparatus of Example I about in the same proportion to the increase in air consumption. As compared with the apparatus of Example IV, the apparatus of Example V also shows enhanced efficiency.

While symmetrical designs of apparatus having the draft tube mounted concentrically within the blending vessel are preferred, because of the more efficient utilization of space which they provide for the containment of solids to be blended, asymmetrical designs of apparatus operate approximately as well. Thus, an apparatus which was effectively a vertical quarter section of the apparatus of FIG. 4, utilizing only one planar baffle 30 and having its draft tube mounted vertically along the junction of the two radial section planes, operated with good efficiency. This demonstrates that there is little criticality as regards relative spatial location of the different elements of the apparatus, which is advantageous as regards fabrication tolerances as well as ease of accommodation of apparatus within restricted spaces in manufacturing plants.

It has been noted that apparatus of this invention performs an incidental classification action during blending operation, in that fines are entrained out of discharge pipe 17 and can be readily recovered in a downstream air filter. This can be a concurrent benefit accompanying the blending, especially where the solids are ultimately used as extrusion stock where particle size uniformity is essential for long term extrusion machine set-up adjustments and the like.

Another design of apparatus utilizing an expanded antechamber 37' is that detailed in FIGS. 5 and 5A, in which the upper cylindrical shell 11''' is omitted for simplicity in the showing. Here, baffles 30 and 31 are omitted and an arcuate solids flow restricter plate 53, sloped outwardly an amount of about 30° at the top edge to prevent hang-up of solids and attached around the lower end of element **37*b'*, is substituted. Plate 53 overlies the solids escape end of frusto-conical section 12''' and thereby throttles flow of solids therethrough to preserve a preselected differential flow throughout the annular space surrounding draft tube 15'''. For best results in the prevention of solids cross-flow, it is preferred to mount vertical baffles 54 around the entire circumference of the annular volume defined by element 37*b'* and the inside surface of cone bottom 12'''. A typical number of ten such baffles is shown in FIG. 5A**, in this instance disposed circumferentially at equiangular spacings of 36° apart, although, if desired, a different circumferential distribution can be employed in order to obtain yet other individual solids weight fraction flows as hereinafter described.

The profile of plate 53 was chosen to preserve a solids residence time, by which is meant the time a particle dwells in bed 23, varying linearly with the number of individual solids delivery channels defined by baffles 54, starting from 9 o'clock position and going to 3 o'clock position, as seen in FIG. 5A. Since the plate is symmetrical about the 3 o'clock-9 o'clock axis, apertures in mirror image relationship on opposite sides of this axis deliver equal weight fractions of solids, so that the term "different residence times", as employed in the claims, is not limited to the situation where the residence time of each separate solids weight fraction delivered from the bed 23 is, in fact, different from all others delivered from the bed.

Figure 17:
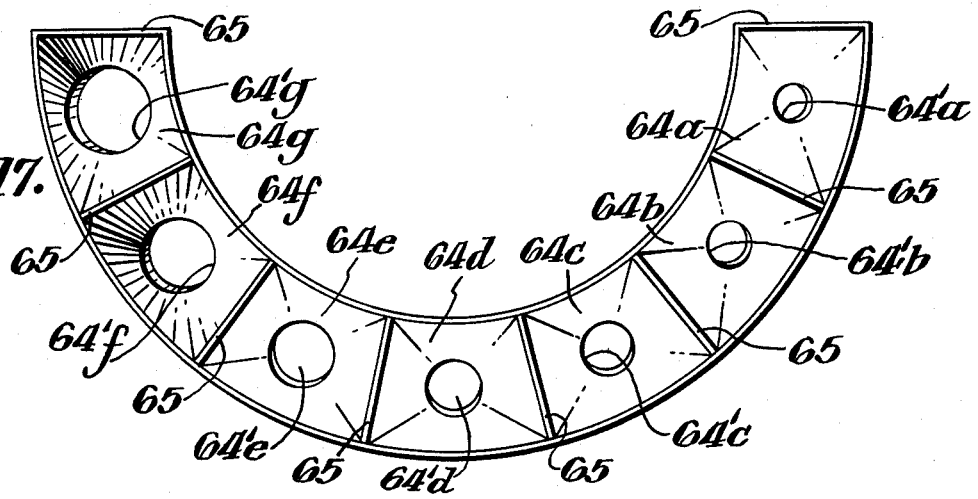

Yet another embodiment of solids flow regulating means according to this invention is that of FIG. 17 which depicts, in plan, a 180° section of a subassembly which can be slipped into the annular interspace (FIG. 4) between the frusto-conical bottom section 12'' and the junction line of the antechamber elements **37*a* and 37*b***.

In FIG. 17 there are shown seven downwardly depending frusto-conical spouts **64*a*–64*g* each having circular discharge orifices 64*a'*–64*g'*, respectively, increasing progressively in diameter from the right to the left and each inclined angularly toward the center of draft tube 15'' (not shown in FIG. 17) so that the axes of the orifices are substantially coparallel with elements defining the inverted frusto-conical bottom section 12''. It will be understood that a companion subassembly (not shown) is employed to close off the remaining 180° of the annular interspace, the orifices of which are of the same size as those shown in FIG. 17, again increasing in diameter progressively from right to left. The top side edges 65 of the several spouts serve somewhat as solids cross-flow prevention baffles; however, if desired, these can be supplemented by radially disposed baffles separating adjacent spouts and having the general design of the elements 54, FIGS. 5 and 5A**.

Figure 18:
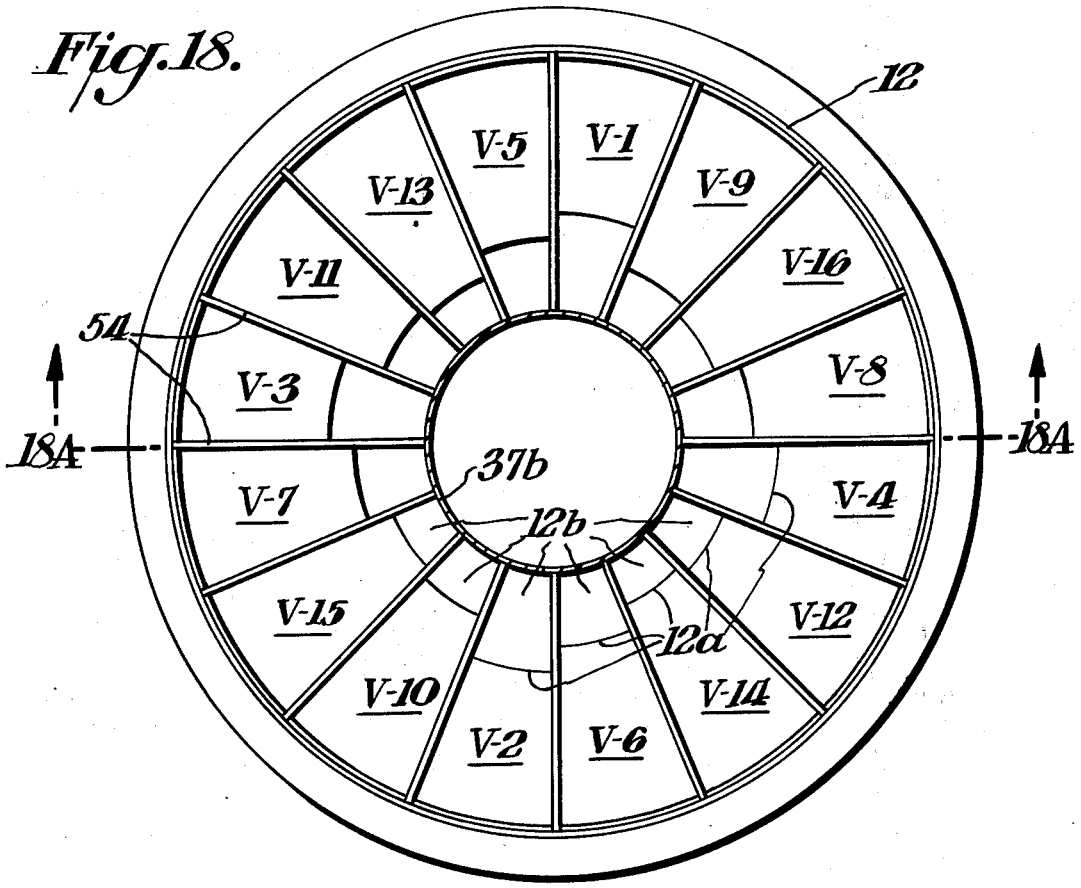
Figure 18A:
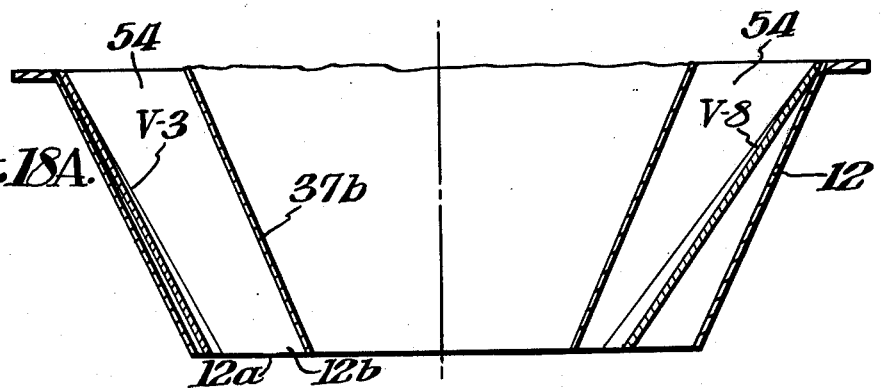

Yet another embodiment of solids flow regulating means is the discharge chute assembly shown in FIGS. 18 and 18A. Here frusto-conical bottom section 12 is provided on the inside with a false bottom consisting of a plurality of fixed, inwardly inclined valve plates V-1 to V-16, each disposed between neighboring radial full height baffles 54 at a different preselected inward inclination (in all cases greater than the solids angle of repose) with respect to the horizontal from the other chutes. All of these chutes terminate in arcuate edges **12*a* disposed at the same horizontal level, which is the plane including the entrance end of frusto-conical antechamber bottom element 37*b*, cut away in FIG. 18 to show only the lowermost circular outline thereof. Thus, the different-sized solids exits 12*b* are bounded by baffles 54, terminal edges 12*a* and the outside periphery of the lower extremity of element 37*b*. In a typical construction, the transverse areas of openings 12*b* ranged progressively from about 0.9 sq. ft., for valve plate V-1, to about 0.24 sq. ft. for valve plate V-16. It is preferred to dispose successive valve plates, such as V-1 and V-2, diametrically opposite one another, thereby distributing the outlet areas 12*b*** more evenly transverse the blender vessel.

Sometimes it is desired to increase the resistance of air flow through the bed, thereby routing relatively more air through the draft tube, and consequently increasing the particle recycle action. In such a construction (FIGS. 18 and 18A), the valve plates V-1 to V-16 are converged a slight amount of only about one inch or less from the juncture line of elements **37*a*–37*b* to the plane of the antechamber entrance, so that the ratio of the transverse area measured for each chute at the juncture plane of antechamber elements 37*a* and 37*b* is $\geqq 1.05$ to the transverse area at the terminal end. The solids exits 12*b* in the latter design can also vary from sector to sector in a wide variety of selected patterns; however, they are, of course, somewhat narrower radially than for the previous embodiment hereinbefore described with reference to FIGS. 18 and 18A**.

It is convenient to visualize the separate solids weight fractions as increments extending from the top of bed 23 to the point of discharge into the gas fluidization zone at the base of draft tube 15, and the term "column" is hereinafter employed in designation of these individual increments.

Research work in the field of gravity-flow blending leading to this invention has revealed certain novel principles of operation which are not known to the prior art, and, more importantly, are usually violated in practice, with the result that less effective blending is obtained than might otherwise be the case.

For example, it has been found that the "Mixer Weight Fraction" (MWF, or f), by which is meant the proportion of solids maintained in a highly agitated and fluidized state, is a critical parameter, particularly in the range of fractions from about 0.01 to 0.20. It has further been found that control of individual solids residence times is also very critical, especially in terms of the aspects (a) distribution of solids circulation and (b) Residence Time Ratio (i.e., RTR), which is treated herein as the ratio of the longest circulation time to the shortest. These aspects are particularly important in reducing the energy and time required for blending.

Fluidized and intensely agitated solids blending and reaction systems, wherein most or all of the solids are fluidized and moving at relatively high velocities, have long been known. U.S. Pat. Nos. 3,159,383 and 3,386,182 describe mixing systems which use these principles. These systems are, however, expensive, especially for larger and more dense solid particles. High power input is necessary to suspend and move the particles, and a larger vessel is required due to the expansion of the solids bed. We have found that it is not necessary to have the major portion of the solids bed in such a fluidized state, but that maintaining a relatively small portion of the solids in well-mixed condition attains a surprisingly large reduction in blend time.

It is helpful to consider the manner in which solids flow downward by gravity in vessels generally used for blending. As solids are removed from an opening at the extremity of the bottom cone, the higher pellets in contact with the lower pellets tend to move downward to replace the pellets removed. This movement is transmitted up through the bed in a manner depending upon the flow properties of the solid. The amount of lateral movement occurring is controlled by the geometry of the vessel and the flow properties of the solid. In any case, a column of downwardly moving pellets exists above every bottom exit. If the pellets removed from the exit are returned to the top of the vessel, then the pellet flow can be described by: (1) an average circulation time (i.e., the average time to move from the top of the bed to exit and return), (2) a ratio between the longest and shortest residence times, and (3) any function describing the residence time of each weight fraction in the moving column. A number of such columns can be considered until the total blender weight is being recirculated and the Residence Time Ratio (RTR) for the slowest to fastest moving fractions and the Residence Time Distribution (RTD), i.e., the residence time relationship one-to-another of all solids columns in circumferential order around the blender vessel, are defined for all fractions of the total blender. In our calculations of RTR, the mixer residence time, being negligible, was not included and thus the RTR and RTD are based exclusively on the transport times in the gravity flow bed.

The effects which the foregoing have on blending are complex, and physical model studies of all the variables would be extremely time-consuming, if not impossible. Fortunately the important elements of the process, i.e., the mixer and its volume, numbers of and volumes of solids columns, and the residence time in each column can be represented accurately by mathematical expressions. A large number of experiments can then be run on a computer within a reasonable length of time. While our calculations permit accurate definition of the performance of a particular blending system, we have not yet developed a model allowing prediction of the optimum system.

Since the course of blending in any given case depends upon the relative dispositions of differing quality particles as they exist at startup in the main solids body, i.e., within cylindrical vessel 11 (FIG. 1), of the blending apparatus, applicants chose two widely different test conditions for purposes of comparision, these being: (1) layer fill, consisting of loading a distinctively colored layer of one resin on top of a differently colored main resin in the arbitrary proportion of less than about 1% for the former to about 99% of the latter, and (2) 0.5 fill, consisting of half the total solids volume being a layer of one type of resin, whereas the remaining 50% is a layer of another type. Actually, this latter condition is much more frequently encountered in industry than the former, a typical case being that wherein one batch of resin contains 1000 ppm antioxidant whereas a previous or succeeding batch contains zero ppm of the additive. The system is then arbitrarily accepted as blended when the concentrations in all volume elements are within 10% of the final average concentration.

Figure 6:
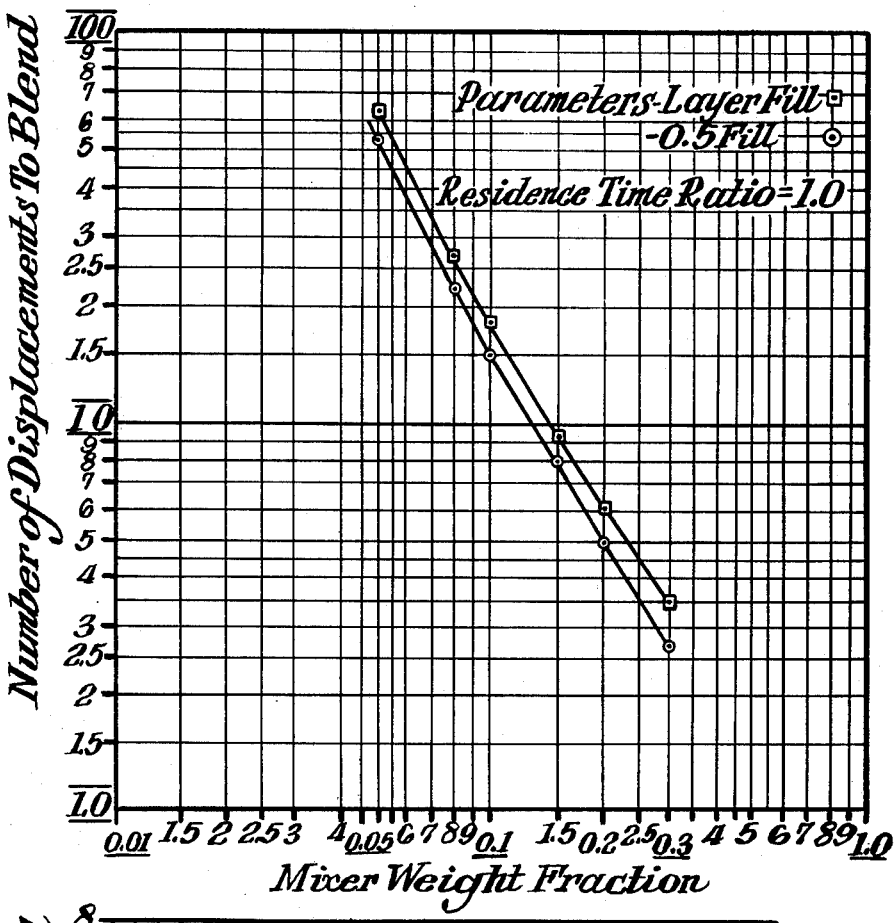

FIGS. 6–10 and FIGS. 11A and 11B illustrate some of the results of blending experiments conducted on a computer with the mathematical moded. Referring now to FIG. 6, which is a log-log plot of Mixer Weight Fraction versus Number of Displacements (turnovers through blending apparatus) to Blend (NDB), it is seen that blending efficiency increases rapidly with Mixer Weight Fraction and that, while it is slightly more difficult to effect blending in the layer fill situation than for 0.5 fill, parallel conditions exist and there is no disabling factor barring blending in either case. It will be noted that a Residence Time Ratio (RTR) (of particle flows in columns) of 1.0 was employed in all FIG. 6 tests, meaning that the transport times or residence times of all pellets in all equal weight fractions withdrawn were equal as the pellets were circulated from the mixer to the solids bed and flowed by gravity back to the mixer.

Figure 7:
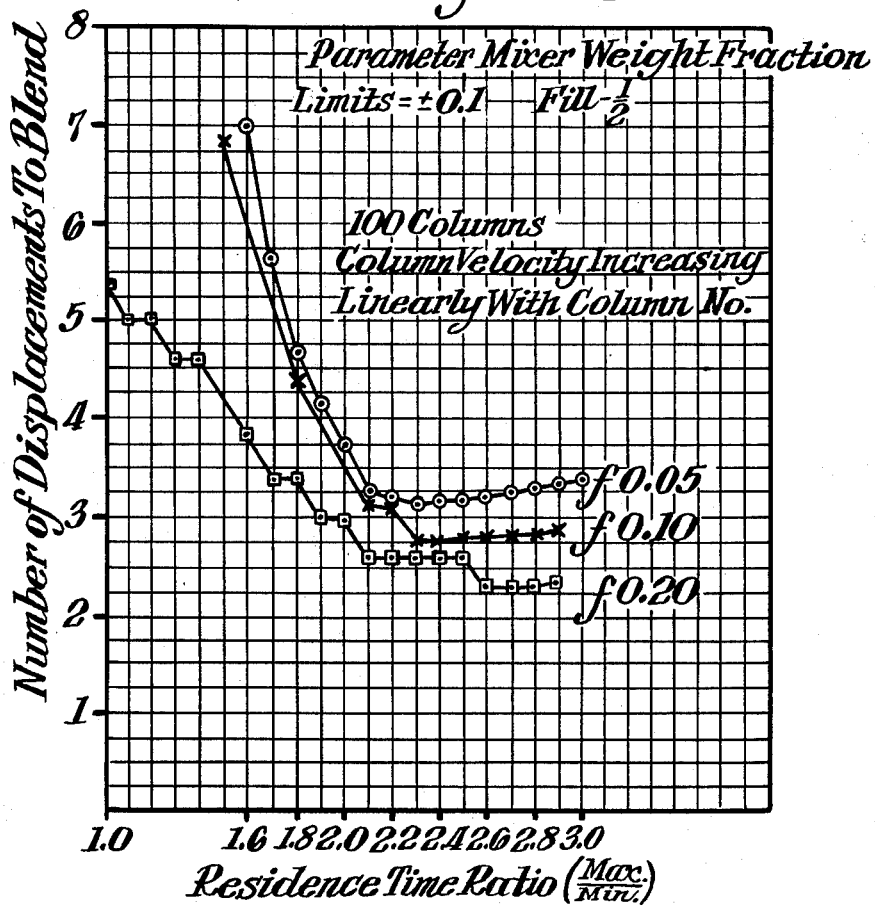

FIG. 7 (for a 100 equal weight fraction, i.e., column, apparatus) is a linear plot of the Number of Displacements to Blend (NDB) versus the Residence Time Ratio (RTR) with parameters of MWF (Mixer Weight Fraction). Thus the combined effects of Residence Time Ratio and MWF can be seen. For these tests, the residence time in each column was determined by increasing the pellet velocity directly with the weight fraction number while employing the slowest and fastest column velocities to obtain the indicated Residence Time Ratio (Max./Min.). As can be seen from FIG. 7, a blender with a 0.05 fraction "Mixer" will blend in about 3.2 Displacements while a 0.10 MWF reduces the NDB to about 2.75.

FIG. 8 is again a plot of the NDB (Number of Displacements to Blend) versus Residence Time Ratio with parameters of Mixer Weight Fraction. However, in these tests, the Residence Time Distribution (RTD) has been changed. The residence time (rather than velocity) for each weight fraction was increased linearly with weight fraction number while maintaining the ratio of the slowest to the fastest as shown. As can be seen in comprising FIGS. 7 and 8, a surprising reduction in turnovers to blend from 3.2 (FIG. 7) to about 2.1 (FIG. 8) for a 0.05 "Mixer" was obtained with this manner of adjusting Residence Time. Note also that the optimum RTR was about 4.0 for a 0.05 fraction "Mixer".

Figure 8:
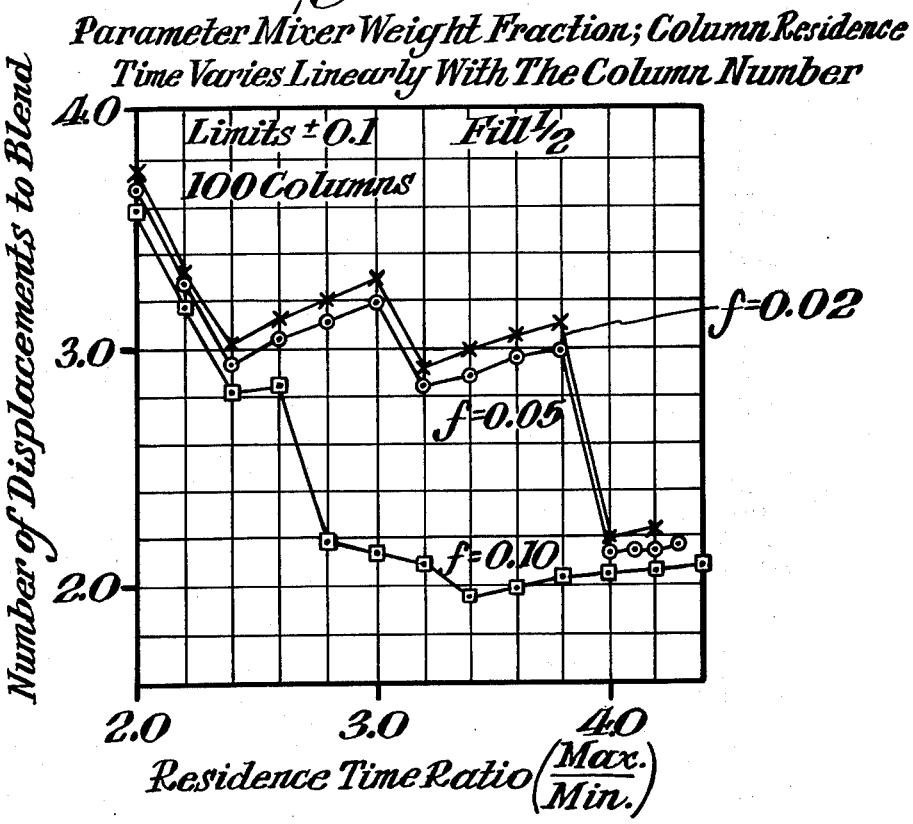
Figure 9:
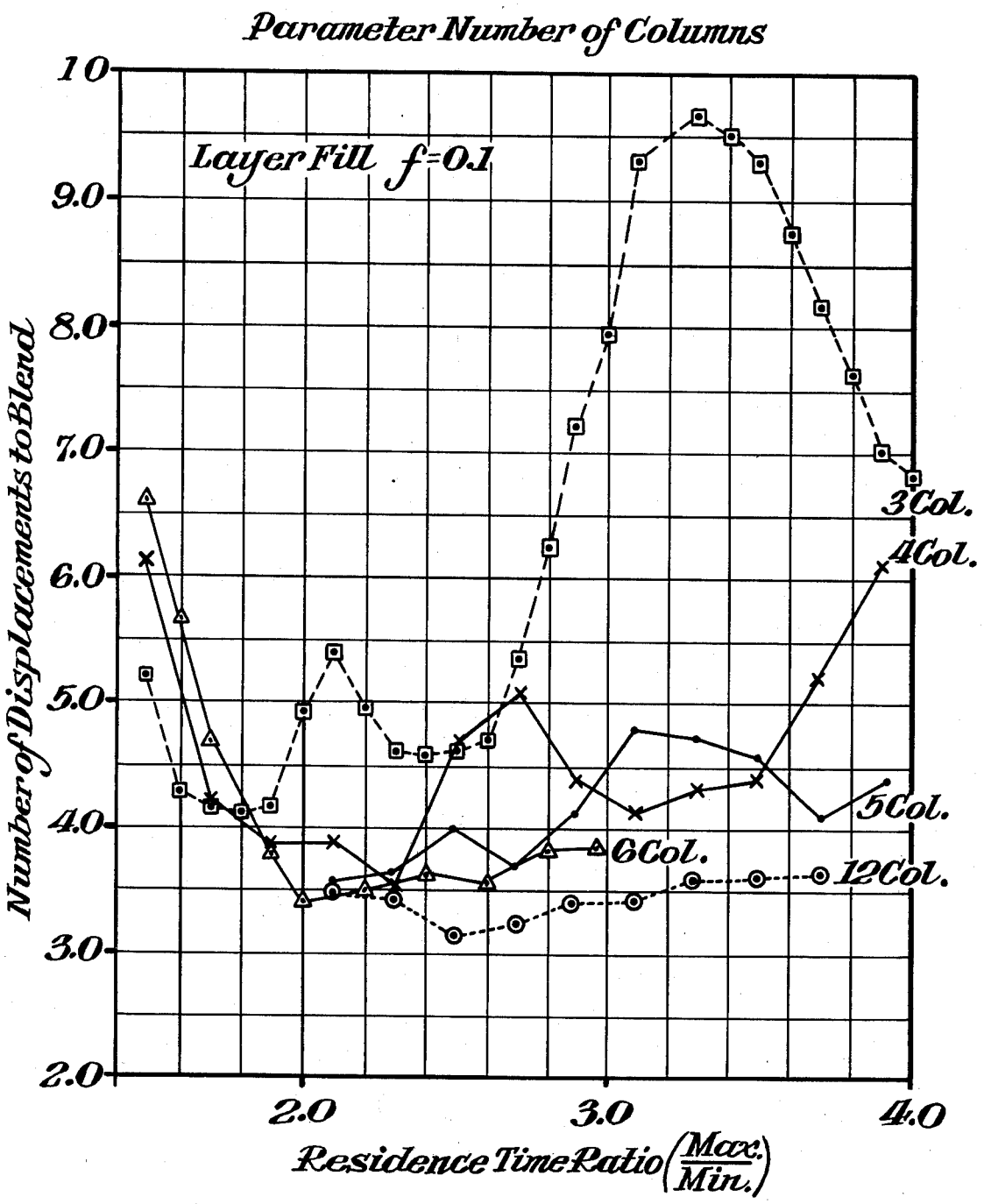

FIG. 9 is a plot of the NDB against the RTR with parameters of the number of equal weight fractions withdrawn from the blending system. The well-mixed volume contains 0.1 of the total weight of pellets and the residence time is distributed linearly with weight fraction number. Layer fill was used in this test to determine the number of weight fractions required. The plot shows that increasing the number of equal weight fractions withdrawn from 3 to 6 reduces the NDB and decreases the sensitivity to Residence Time Ratio (RTR). Further increasing the number of equal weight fractions withdrawn from 12 to 100 was found to make almost no change in the NDB. Comparing FIGS. 8 and 9 permits another comparison of the increased time to blend (approximately one additional displacement) when testing with a thin layer of markers on top of the bed.

The data from blending tests with the physical models and with the computer model appear to contain some inexplicable results. For example, as seen in FIG. 8, as the RTR is increased from 3.8 to 4.0 the NDB abruptly drops by about one turnover for the "Mixer Weight Fractions" of 0.02 and 0.05, while with a MWF of 0.1 the NDB drops rather abruptly between an RTR of 2.6 and 2.8. Consideration of the many data displays and tests conducted on the computer and physical models indicate, surprisingly, that these results are indeed real and attributable to a phenomenon similar to resonance.

Figure 10:
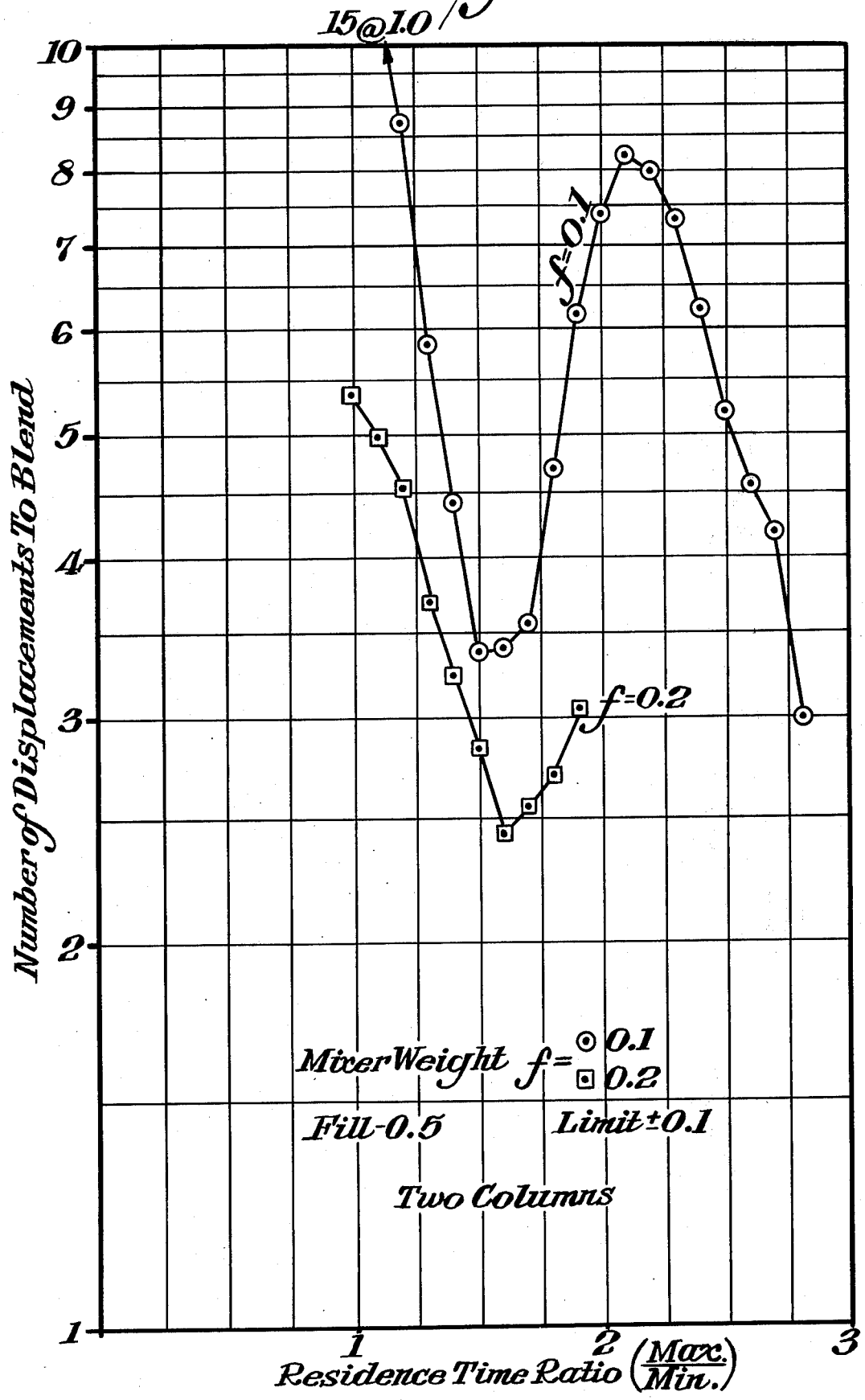

The phenomenon of resonance may be described by referring to FIG. 10, and FIGS. 11A and 11B. FIG. 10 relates the NDB versus the RTR for a simple two equal weight fraction model with the well-mixed fractions of 0.1 and 0.2. Note the wide oscillation in NDB as the RTR is increased from 1 to 3 and note that two minima are obtained. To further search for an understanding, the concentration of markers exiting the mixer (by which is meant the concentration of black, blue or other distinctively colored minority particles incorporated as trace material) was plotted as a function of number of displacements (time) and is shown in FIG. 11A for the RTR (2.1) coinciding with a maximum NDB. FIG. 11B indicates the marker concentration vs. number of displacements (time) for the RTR (1.6) coinciding with a minimum NDB.

It must be remembered that both minima and maxima marker concentrations exiting the mixer are returned to the downward moving bed and are thus stored until they again flow into the mixer. In FIG. 11A, with the Residence Time Ratio of 2.1, the two equal weight fractions and their stored concentrations, minima and maxima, are fed to the mixer such that the concentration maxima are reinforced and the concentration minima are also reinforced. As shown in FIG. 11B, with an RTR of 1.6, these concentration minima and maxima which are stored in the weight fractions are fed to the mixer at rates such that the minima from one weight fraction very nearly enters the mixer with maxima from the other weight fraction. Thus, they are out of phase, and no concentration reinforcement occurs. Blending, therefore, is achieved most rapidly with the out-of-phase condition shown in FIG. 11B. This reinforcement or resonance phenomena explains the seemingly erratic behavior of many blending systems comparatively tested.

Figure 12:
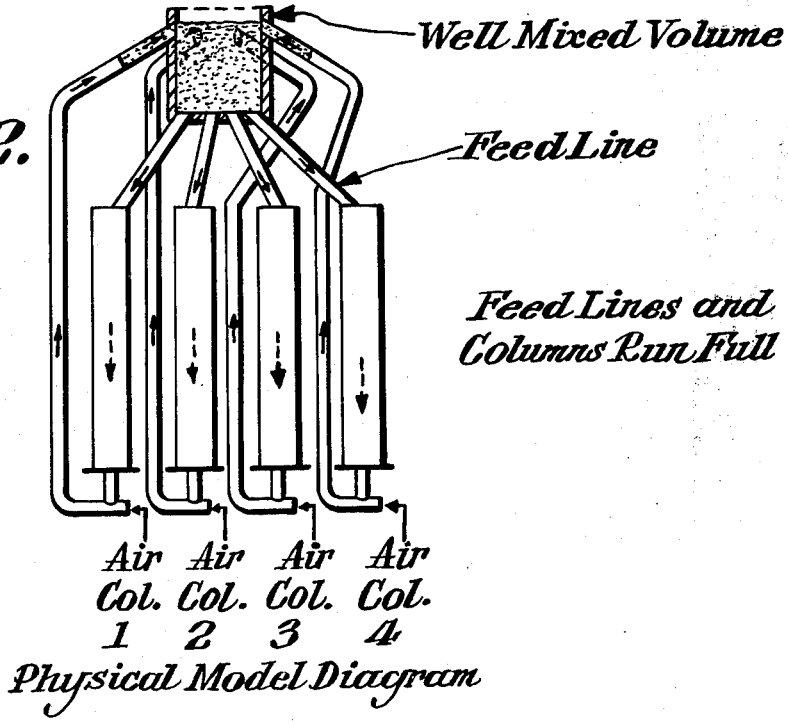

The mathematical model is basically very straightforward, and the only assumption required is that the solids can be made to flow in the manner described. However, referring to FIG. 12, to further substantiate its validity, a four-column physical model was built and tested. Separate conveying lines were used such that adjusting the air flow permitted adjusting the Residence Time in each column. Separate inlet pipes were used to assure maximum uniformity of residence time in each column. The conveyors empty into a separating vessel and the impingement created a region of high pellet velocity and a great deal of random movement Measurements indicated that about 2% of the total pellets were in this well-mixed zone at any given time.

Figure 13:
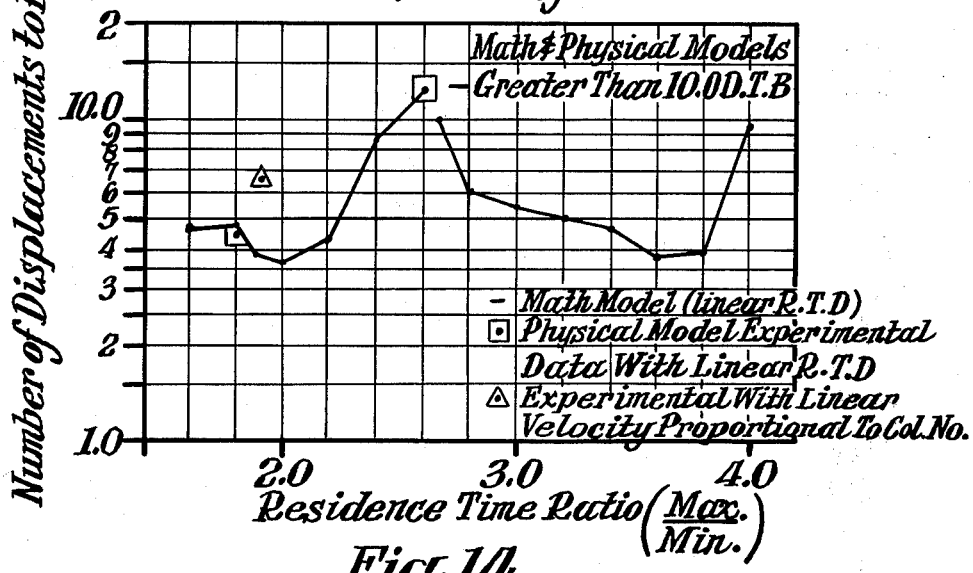

The data from tests of this physical model were compared with calculations from the mathematical model in FIG. 13. Two tests with a linear Residence Time Ratio (Max./Min.) were made and these points appear as squares on the diagram, and check the calculated performance very closely. A single test with the column velocity distribution adjusted to be linear with column number is indicated by the triangle and confirms that Residence Time Distribution linear with column number does indeed give reduced NDB as compared with the linear velocity distribution.

Figure 14:
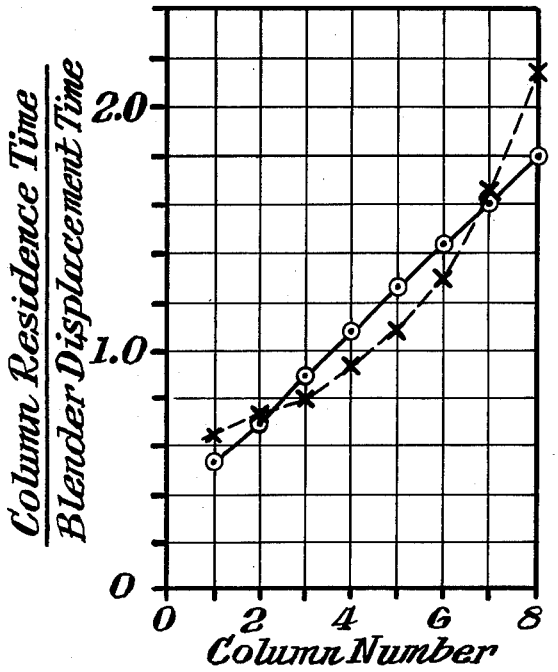

FIG. 14 is included to better describe the concepts of Residence Time Ratio (RTR) and Residence Time Distribution (RTD). In FIG. 14 the Column Residence Time divided by the Blender Displacement Time is plotted against the column number. The column residence time is that required for a pellet within said column to travel from the top of the column and return to its starting position, since no mixer was used. All pellets within a single column have been given the same residence time and, in the example illustrated, eight columns are used to make up the blender. Thus each column represents one-eighth of the total weight to be blended. The blender displacement time was found by dividing the blender weight by the sum of the flow from each column. This sum, or the total recirculation flow, was held constant.

Two different Residence Time Distributions are illustrated. In the RTD shown with circles, the column residence time was increased as a linear function of the column number while maintaining an RTR of 3.33. In the second case, the column velocity was increased with column number. The reason that the linear RTD gives the shortest blend time is not completely understood but may be a result of more uniform feed of concentration layers to the mixer.

Turning to the mechanical design of the draft tube blender, it is most advantageous to obtain columns with different downward velocities and thus different residence times around the central bulb and conveyor. Since the free-flowing solids generally tend to flow directly downward, this can be conveniently achieved by the valve arrangement shown in FIGS. 15 and 16. These valves permit adjusting the flow area at the bottom of each column.

Figure 15:
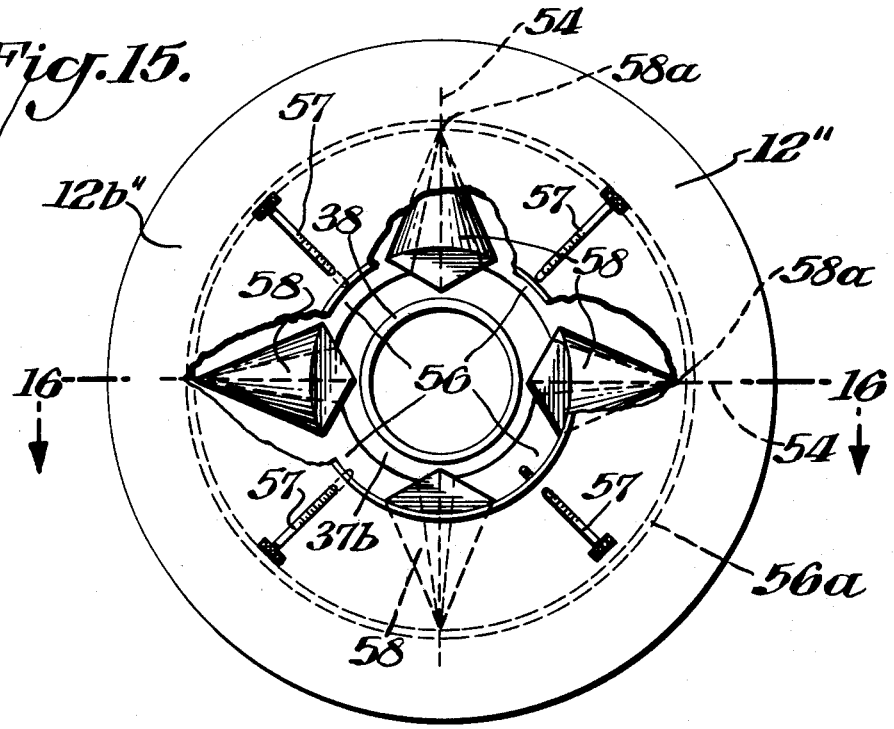
Figure 16:
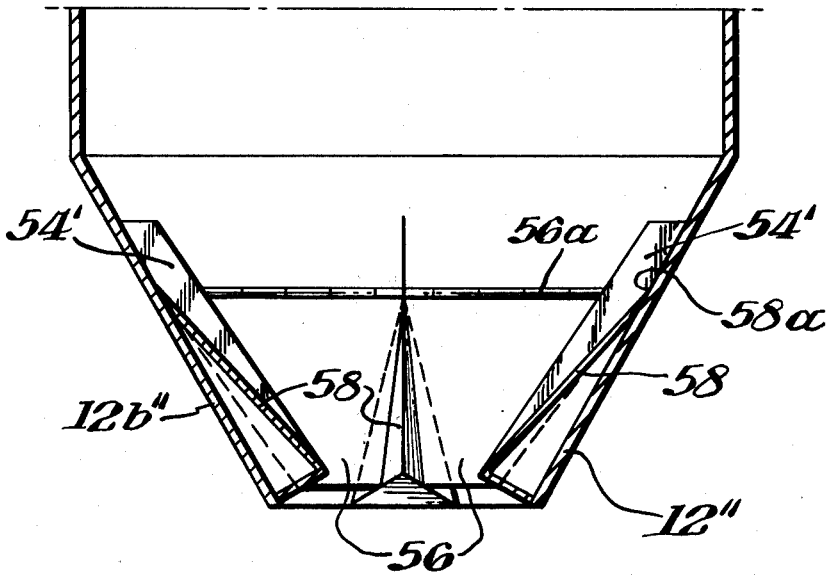

The design of FIGS. 15 and 16 is shown as having only four solids flow control valves, although, of course, a greater number is preferred and can be readily accommodated without interference one with another.

The individual valves 56 conveniently constitute cut-out sections of an inwardly nested false conical bottom section telescoped within conical bottom section 12'', each section being hinge-supported at the upper ends 56*a* to permit lateral movement with respect to element 37*b*. Push rods 57 are provided for preselected settings of each individual valve.

In order to close off the interspaces between adjacent edges of valves 56, pyramidal filler blocks 58, rigidly supported against movement by secure attachment at their outboard faces to the stationary skirt section 12'', are mounted between valve pairs. Then, as valves 56 open or close, the edges thereof slide over the pyramidal sides of blocks 58 close enough thereto to bar escape of any solids particles being blended but with sufficient clearance to avoid frictional binding of the moving valve edges with respect to the filler blocks.

If the valve pieces 56 are edge cut sufficient amounts at their lower terminal edges, the inboard edges of pyramidal blocks 58 can extend inwardly far enough to constitute partially effective separators barring any circumferential displacement of solids from one column to another. Full length baffling equivalent to that hereinbefore described with reference to FIGS. 5 and 5A can then be achieved by welding fins 54' to the inboard edges of the pyramidal blocks as shown in FIG. 16, in which case the inner edges abut at all times against the confronting outside surface of element 37*b* (omitted from this view to better show the details of the filler blocks).

Similar results can be obtained by properly sized orifices at the bottom of each column sector. However, the adjustable valves are useful, particularly where the flow properties of the solids are not adequately known or where the blender is operated on more than one type of solid.

Considering all of the test results obtained and the discovery of the resonance phenomenon, it is concluded that it is most advantageous to account for the following in designing and operating systems to blend free-flowing solids:

1. A substantial well mixed fraction (0.01–0.20) is desirable to decrease blend time, but it is also obviously more expensive, due to the power required to keep a larger volume of solids in a highly agitated state. Thus the size chosen will be the smallest which will give the desired blend times with optimization of all other blender variables.

2. Residence Time Ratio should be controlled between about 1.5 and 5.0, depending on the mixer size, number of columns, composition difference to be blended, and the Residence Time Distribution. An RTR smaller than 1.5 invariably causes excessive concentration amplitude peaks as the material exits the mixer, and thus longer blend times. An RTR larger than 5.0 causes longer blend times due to the time required to displace the slower moving columns. There is not a direct relationship between RTR and blend times, but the optimums lie within the 1.5–5.0 range.

3. Residence Time Distribution and the number of columns employed should be designed to obtain the most constant feed of the concentration disturbance into the mixer and therefore the smallest amplitude of concentration cycles exiting the mixer. Thus, a residence time distribution that is linear with column number and a larger number of columns are desirable. The number of columns should preferably be more than five for most blending tasks.

What is claimed is:

1. A particulate solids blending apparatus comprising, in combination, a vessel containing a settled bed of particulate solids to be blended consisting of an upright top section to which is joined a funnel type bottom section, a draft tube vertically disposed with respect to said top section with lower end in open communication with said funnel type bottom section and upper end in open communication with the top of said top section, means fluidizing a well-mixed fraction of about 0.01 to 0.20 of said solids in the region adjacent said lower end of said draft tube, means entraining solids upwardly through said draft tube, and solids flow-constricting means spaced inwardly from the inside wall of said upright top section disposed in the gravity flow paths of solids contained within said bed maintaining different residence times of separate weight fractions of said solids within said settled bed having residence time ratios in the range of about 1.5 to 5.0 while withdrawing said solids in downward gravity flow from said settled bed to said region adjacent said lower end of said draft tube provided with said means fluidizing solids.

2. A particulate solids blending apparatus comprising, in combination, a vessel containing a settled bed of particulate solids to be blended consisting of an upright cylindrical top section to which is joined an inverted frusto-conical bottom section, a draft tube disposed substantially coaxially with respect to said cylindrical section with lower end in open communication with said frusto-conical bottom section and upper end in open communication with the top of said cylindrical section, means fluidizing a well-mixed fraction of about 0.01 to 0.20 of said solids in the region adjacent said lower end of said draft tube, means entraining solids upwardly through said draft tube, and solids flow-constricting means spaced inwardly from the inside wall of said upright top section disposed in the gravity flow paths of solids contained within said bed maintaining different residence times of separate weight fractions of said solids within said settled bed having residence time ratios in the range of about 1.5 to 5.0 while withdrawing said solids in downward gravity flow from said settled bed to said region adjacent said lower end of said draft tube provided with said means fluidizing solids.

3. A particulate solids blending apparatus according to claim 2 wherein the lower end of said draft tube is enlarged to form an antechamber of increased cross-section wherein fluidization of said solids occurs.

4. A particulate solids blending apparatus according to claim 3 wherein said solids flow-constricting means comprises radially adjustable valve means disposed substantially coaxially of said inverted frusto-conical bottom section and radially disposed solids cross-flow prevention baffles spaced circumferentially at predetermined intervals with respect to said inverted frusto-conical bottom section.

5. A particulate solids blending apparatus according to claim 3 wherein said solids flow-constricting means comprises a multiplicity of orifices of preselected diameters arranged with axes substantially coparallel with elements defining said inverted frusto-conical bottom section and radially disposed solids cross-flow prevention baffles spaced circumferentially at predetermined intervals with respect to said inverted frusto-conical bottom section.

6. A particulate solids blending apparatus according to claim 3 wherein said solids flow-constricting means comprises a plate disposed substantially radially of said draft tube across the interspace defined by the inside surface of said frusto-conical bottom section and the lower outside surface of said antechamber, said plate having a projected planar shape throttling solids flow past said plate in a circumferential pattern effecting withdrawal at preselected different flow rates of separate weight fractions of solids from said bed to said region adjacent said lower end of said antechamber provided with said means fluidizing solids and radially disposed solids cross-flow prevention baffles spaced circumferentially at predetermined intervals with respect to said inverted frusto-conical bottom section.

7. A particulate solids blending apparatus according to claim 3 wherein said antechamber constitutes two opposed frusto-conical sections joined end to end at the large diameter ends with the junction line of said frusto-conical sections disposed within said inverted frusto-conical bottom section.

8. A particulate solids blending apparatus according to claim 3 wherein said solids flow-constricting means comprises a plurality of solids discharge chutes wherein the bottom walls have preselected inward inclinations with respect to the horizontal greater than the angle of repose of said solids and define openings between the chute terminal ends and the entrance end of said antechamber preselected in area to secure predetermined rates of solids discharge therethrough.

9. A particulate solids blending apparatus according to claim 2 wherein said solids flow-constricting means comprise helically formed plates disposed coaxially of said draft tube within the annular space defined by the inside wall of said cylindrical top section and the outside wall of said draft tube.

10. A particulate solids blending apparatus according to claim 2 wherein said solids flow-constricting means comprise planar baffles inclined at an angle to the vertical greater than the normal angle of repose of said solids being blended disposed within the annular space defined by the inside wall of said cylindrical top section and the outside wall of said draft tube.

* * * * *